US009303947B2

(12) United States Patent
Warner

(10) Patent No.: US 9,303,947 B2
(45) Date of Patent: Apr. 5, 2016

(54) MULTI-PURPOSE ARCHERY TOOL

(71) Applicant: Easton Technical Products, Inc., Salt Lake City, UT (US)

(72) Inventor: Clinton Jay Warner, Lehi, UT (US)

(73) Assignee: EASTON TECHNICAL PRODUCTS, INC., Salt Lake City, UT (US)

( * ) Notice: Subject to any disclaimer, the term of this patent is extended or adjusted under 35 U.S.C. 154(b) by 218 days.

(21) Appl. No.: 14/051,967

(22) Filed: Oct. 11, 2013

(65) Prior Publication Data

US 2015/0101128 A1 Apr. 16, 2015

(51) Int. Cl.

| | |
|---|---|
| ***B25B 7/22*** | (2006.01) |
| ***F41B 5/14*** | (2006.01) |
| ***B25F 1/00*** | (2006.01) |
| ***B25B 7/02*** | (2006.01) |
| *B25B 7/12* | (2006.01) |

(52) U.S. Cl.
CPC . *F41B 5/148* (2013.01); *B25B 7/02* (2013.01); *B25B 7/22* (2013.01); *B25F 1/003* (2013.01); *B25B 7/123* (2013.01)

(58) Field of Classification Search
CPC ..... B25B 7/02; B25B 7/22; B25B 7/123; B25B 27/02; B25F 1/003
USPC ..... 81/302, 304, 305; 7/125
See application file for complete search history.

(56) References Cited

U.S. PATENT DOCUMENTS

| | | | | |
|---|---|---|---|---|
| 807,240 | A * | 12/1905 | Carstensen | 29/283.5 |
| 1,338,804 | A * | 5/1920 | Woodworth | 72/392 |
| 1,399,665 | A * | 12/1921 | Shapiro | 7/130 |
| 4,289,015 | A * | 9/1981 | Porter | 72/384 |
| D276,880 | S | 12/1984 | Tozaburo | |
| 4,539,873 | A * | 9/1985 | Freed | 81/311 |
| 5,165,155 | A * | 11/1992 | Adams | 29/268 |
| 6,257,105 | B1 * | 7/2001 | Lin | 81/302 |
| 6,789,452 | B1 * | 9/2004 | Tseng | 81/311 |
| 7,448,301 | B1 * | 11/2008 | Cronin | 81/302 |
| 8,622,096 | B2 * | 1/2014 | Yang | 140/123 |
| 8,628,070 | B2 * | 1/2014 | Neubauer | 269/55 |
| 2007/0187660 | A1 | 8/2007 | Clark et al. | |
| 2011/0154958 | A1 * | 6/2011 | Wang | 81/302 |
| 2012/0085982 | A1 * | 4/2012 | Blosser | 254/248 |

FOREIGN PATENT DOCUMENTS

EP 1110675 A2 6/2001

OTHER PUBLICATIONS

Carbon Express, Inc. String-loop nocking pliers advertisement. Web Archive Catalog [online] Oct. 22, 2011 [retrieved on Nov. 26, 2014]. Retrieved from the Internet: ,URL: https://web.archive.org/web/20111022020937/http://www.carbonexpressarrows.com/archery/arrow-accessories/string-loop-nocking-pliers>.

International Search Report for PCT International Application No. PCT/US2014/056370, mailed Dec. 31, 2014 (2 pp.).

* cited by examiner

*Primary Examiner* — Hadi Shakeri
*Assistant Examiner* — Danny Hong
(74) *Attorney, Agent, or Firm* — Holland & Hart

(57) ABSTRACT

A multi-function archery tool includes first and second handle members, and first and second sets of jaws. The first set of jaws includes first and second jaw members movable toward each other to clamp a nock point upon moving the first and second handle members toward each other. The second set of jaws includes third and fourth jaw members movable away from each other to tighten a bowstring string loop upon moving the first and second handle members toward each other.

21 Claims, 9 Drawing Sheets

MULTI-PURPOSE ARCHERY TOOL

TECHNICAL FIELD

The instant disclosure relates generally to the field of archery equipment, and particularly to multi-function tools used to mount accessories to archery bowstrings.

BACKGROUND

In the general field of archery, bow mechanics employ particular tasks that are unique to archery bows. Specific tools are needed to adequately and efficiently perform these tasks. Some of these tasks include: (1) installing and tightening a string loop or "D-Loop" to a bowstring, wherein the string loop defines the location where an arrow is nocked on the bowstring, (2) setting, adjusting, and removing brass nock points (or archery nocks) on a bowstring, wherein the nock point designates the location where the arrow is nocked on the bowstring, and (3) securing "tie-in" bowstring-mounted components such as peep sites, arrow-rest drop cords, anchor point location aids, "kisser buttons," and other similar devices using additional nock points or small diameter serving threads that extend through strands of the bowstring.

Many useful tools currently exist to perform each of these tasks. These tools may be referred to as pliers, accessory tools, or multi-function tools. The devices already on the market primarily target single functions, although a few multi-function tools are available. The single-function tools are used to perform any one of the tasks discussed above. Multi-function tools provide some functionality by squeezing the handles of the device together, while other functions are performed by pulling the handles apart. Pulling the handles apart typically involves a two-handed operation, which is cumbersome and decreases mechanical advantage. Further, a two-handed pull apart of the handles may require significant physical strength to adequately achieve the desired function. A need exists in this technical field for improved tools for use in mounting accessories and performing other functions related to bowstrings of an archery bow.

SUMMARY

One aspect of the present disclosure relates to a multi-function archery tool that includes first and second handle members, and first and second sets of jaws. The first set of jaws includes first and second jaw members movable toward each other to clamp a nock point point upon moving the first and second handle members toward each other. The second set of jaws includes third and fourth jaw members movable away from each other to tighten a string loop on a bowstring upon moving the first and second handle members toward each other.

The first and third jaw members may be integrally formed as a single piece with the first handle member, and the second and fourth jaw members may be integrally formed as a single piece with the second handle member. The first and second jaw members may be in contact with each other when the multi-function archery tool is in a closed position with the first and second handle members arranged adjacent to each other. The third and fourth jaw members may be in contact with each other when the multi-function archery tool is in an open position with the first and second handle members arranged spaced apart from each other. The first and second jaw members may each include at least one nock recess sized to receive a portion of a nock point. At least one of the first and second jaw members may include a nock removal protrusion.

The third and fourth jaw members may each include an inner facing surface, an outer facing surface, and a string loop receiving recess formed on the outer facing surface. At least one of the first and second jaw members may include a knurled separated jaw portion configured to grasp a portion of the string loop. The first and second jaw members may define a tweezer tip. The first and second handle members may be pivotally connected to each other at a pivot connection point. The third jaw member may be positioned distal of the pivot connection point and the fourth jaw member may be position proximal of the pivot connection point.

Another aspect of the present disclosure relates to a multi-function archery plier having first and second plier members. The first plier member includes a first handle portion positioned at a first end thereof, a first jaw portion positioned at a second end thereof, and a second jaw portion spaced between the first and second ends. The first and second jaw portions may be movable laterally relative to a longitudinal axis of the multi-function archery plier. The second plier member may be pivotally attached to the first plier member and include a second handle portion positioned at a first end of the second plier member, a third jaw portion positioned at a second end of the second plier member, and a fourth jaw portion spaced between the first and second ends of the second plier member. The third and fourth jaw portions may be movable axially relative to the longitudinal axis. Moving the first and second handle portions toward each other may concurrently move the first and third jaw members toward each other and move the second and fourth jaw members toward each other. At least one of the first and third jaw members may define a nock point crimping recess sized to receive a nock point, and the second and fourth jaw members may include at least one string loop recess sized to receive a portion of a string loop.

The first, second and third jaw members may be positioned distal of a pivot connection point between the first and second plier members, and the fourth jaw member may be positioned proximal of the pivot connection point. Each of the first and third jaw members may include at least one nock point crimping recess. At least one of the first and third jaw members may include a nock point removal protrusion. At least one of the first and third jaw members may include a recessed portion positioned adjacent to and surrounding the nock point removal protrusion. The multi-function archery plier may be operable between a fully open position wherein the second and fourth jaw members are in contact with each other, and a fully closed position wherein the first and third jaw members are in contact with each other. The multi-function archery plier may further include a cleat post extending from the first jaw portion and configured for securing a portion of the string loop when attaching the string loop to a bowstring. Each of the first and third jaw members may include a knurled separated jaw section configured for grasping a portion of the string loop when attaching the string loop to a bowstring.

Another aspect of the present disclosure relates to a method of operating a multi-function archery tool. The method includes providing first and second handle members, a first set of jaws having first and second jaw members, and a second set of jaws having third and fourth jaw members. The method further includes pivoting the first and second handle members toward each other to open the second set of jaws to tighten a string loop and close the first set of jaws to either crimp a nock point onto a bowstring or remove the nock point from the bowstring, and pivoting the first and second handle members away from each other to open the first set of jaws to disengage the first set of jaws from the nock point and close the second set of jaws to remove the second set of jaws from the string loop.

The method may also include positioning portions of the string loop within recesses formed in each of the third and fourth jaw members. The method may include positioning portions of the nock point within nock recesses formed in the first and second jaw members. The first and second jaw members may move in a lateral direction relative to a longitudinal axis of the multi-function archery tool, and the third and fourth jaw members may move in an axial direction relative to the longitudinal axis.

A further aspect of the present disclosure relates to a method of operating a multi-function archery tool. The method includes providing first and second handle members, a first set of jaws having first and second jaw members, and a second set of jaws having third and fourth jaw members, and moving the first and second handle members toward each other to close the first set of jaws and open the second set of jaws. The first set of jaws may be configured to crimp a nock point onto a bowstring, remove the nock point from the bowstring, grasp a piece of serving, and/or grasp a portion of a string loop, and the second set of jaws are configured to tighten the string loop onto the bowstring.

Features from any of the above-mentioned embodiments may be used in combination with one another in accordance with the general principles described herein. These and other embodiments, features and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
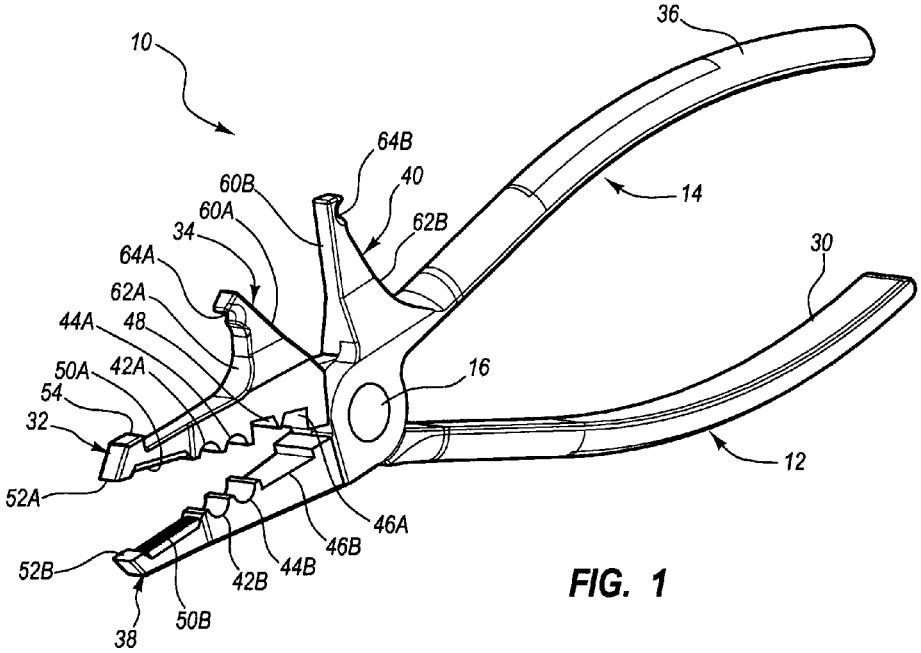
FIG. 1 is a top perspective view of a multi-function tool in accordance with the present disclosure.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of skill in the art will understand that the exemplary embodiments described herein are not intended to be limited to the particular forms disclosed. Rather, the instant disclosure covers all modifications, equivalents, and alternatives falling within the scope defined by the appended claims.

DETAILED DESCRIPTION

The multi-function archery tool of the present application is designed so that all of its functionality is available with a single hand squeeze applied to the handles of the tool in order to move the handles toward each other. The multi-function tool includes two sets of jaws that function simultaneously upon squeezing the handles toward each other. A forward facing jaw includes a traditional plier orientation of opposed jaw members. The jaw members move toward and away from each other in a lateral direction relative to a longitudinal axis of the tool. The multi-function tool also includes a side facing jaw arranged generally perpendicular to the forward facing jaw. The side facing jaw includes opposed jaw members that move toward and away from each other in an axial direction relative to the longitudinal axis of the tool. The design of the multi-function archery tool is optimized for one-handed operation across all of its intended uses. The multi-function archery tool maximizes mechanical advantages for all of its intended purposes, thereby maximizing its overall utility as an archery tool.

The multi-function archery tool is configured to perform a number of tasks and associated functions. One such task relates to pre-stretching a string loop cord and forming a final loop stretch of the string loop. To utilize this function, the operator first ties a half-hitch or other knot in the string loop cord about the bowstring. Next, the user grasps a tag or free end of the string loop cord using a knurled separated jaw section of the forward facing jaw. A free end of the cord is wrapped around a cleat post that is positioned on one of the jaw members of the forward facing jaw. The half-hitch knot is tightened by pulling away from the bowstring while the user squeezes the handles toward each other. Typically, the tool is oriented in line with the string loop cord while applying the pulling force to tighten the half-hitch knot. Lastly, after tying a second half-hitch knot in the free end of the string loop cord under the bowstring, the user tightens the newly formed string loop by placing the side facing jaw members within the loop and adjacent to the bowstring. The operator then squeezes the tool handles toward each other, which causes the jaw members of the side facing jaw to move away from each other (e.g., open), which applies tension in the string loop cord to tighten both half-hitch knots. After the string loop is adequately tightened, the operator moves the tool handles away from each other to release the tension force applied to the string loop and the operator removes the side facing jaw members from the string loop.

Another function provided by the multi-function archery tool relates to mounting a nock point to the bowstring. The nock point is inserted onto the bowstring at a location along the length of the bowstring corresponding to the desired location for nocking an arrow. The operator then opens the forward facing jaw by moving the handles away from each other. The jaw members of the forward facing jaw are positioned around the nock point while it remains in the desired location on the bowstring. The operator then applies a squeezing force to the handles, which applies a crimping (e.g., compression) force to the nock point to secure it to the bowstring.

The nock point may be removed from the bowstring by opening the forward facing jaw and aligning a nock removal protrusion with area where the opposite ends of the nock point meet (having previously been crimped). The jaw members of the forward facing jaw may include recesses adjacent to the nock removal protrusion to accommodate the bowstring and nock point prior to and during removal of the nock point. The user then squeezes the handles of the tool, which forces the nock removal protrusion between the opposite ends of the nock point until they separate and open, like jaws, so that the nock point can be removed from or adjusted relative to the bowstring. The nock removal protrusion may include a wedge shaped construction to assist in prying apart the opposing ends of the nock point.

Another function provided by the multi-function archery tool relates to pulling a serving, thread, or other feature through strands of the bowstring. The forward facing jaw includes a tweezer tip at a distal end thereof. The operator may position the serving between the jaw members of the forward facing jaw and squeeze the handles to grasp the serving with the tweezer tip. The user may then apply a pulling force while squeezing the handles to pull the serving through the bowstring. Alternatively, the tweezer tip may be inserted between the strands of the bowstring and the handles squeezed to grasp a serving with the tweezer tip. The operator than pulls the serving through the bowstring strands.

A further function provided by the multi-function tool is a standard gripping function for other miscellaneous tasks. The user may position any object between the jaw members of the forward facing jaw and apply a squeezing force to the handles thereby gripping the object.

The multi-function tool may include two separate plier members. Each plier member may include a handle portion and first and second jaw members. The first and second plier members may be pivotally mounted to each other. A jaw member from each plier member may coordinate together to form a forward facing jaw, and another jaw member from each plier member may coordinate together to form a side facing jaw. Once assembled, applying a squeezing force to the handles to move the handle portions toward each other causes the jaw members of the forward facing jaw to move toward each other and causes the jaw members of the side facing jaw to move away from each other. A pivot connector may extend between and couple together the first and second plier members with a pivot connection. The pivot connector may include a low friction material or provide a low friction interface with the plier members. The plier members may include pivot apertures sized to receive the pivot connector.

Figure 2:
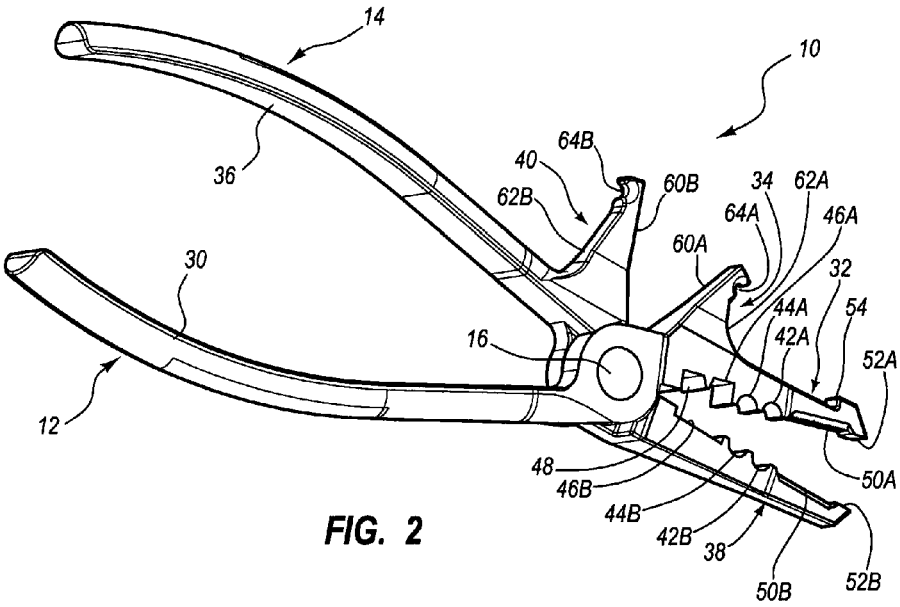
FIG. 2 is a bottom perspective view of the multi-function tool of FIG. 1.
Figure 6:
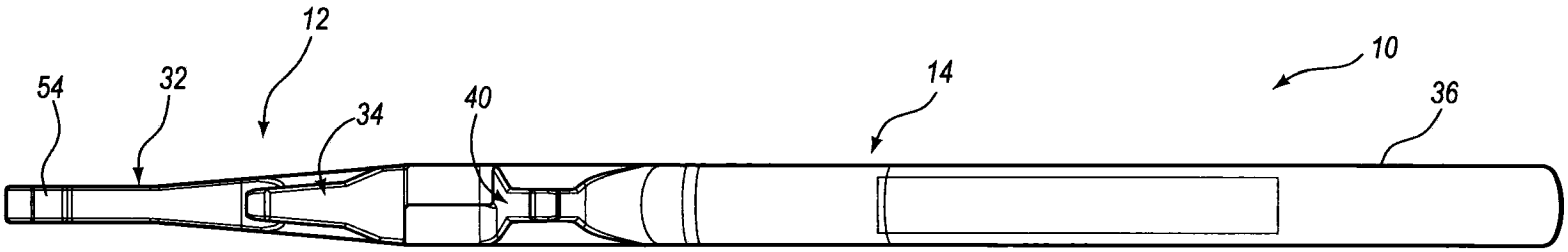
FIG. 6 is a top view of the multi-function tool of FIG. 1.
Figure 7:
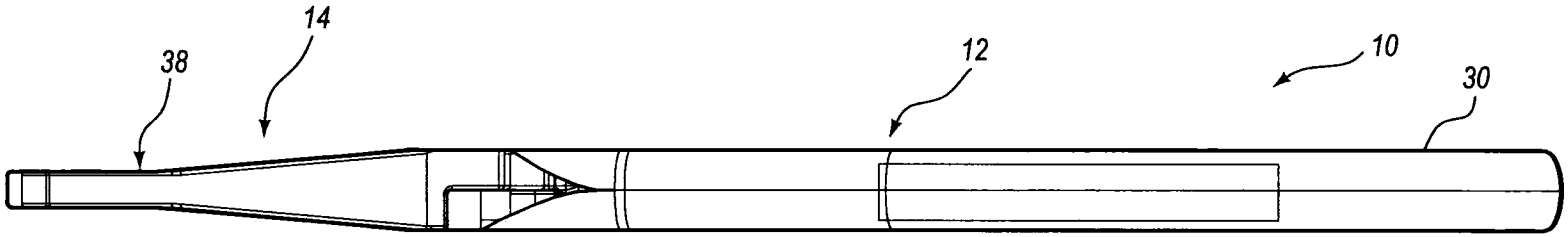
FIG. 7 is a bottom view of the multi-function tool of FIG. 1.
Figure 8:
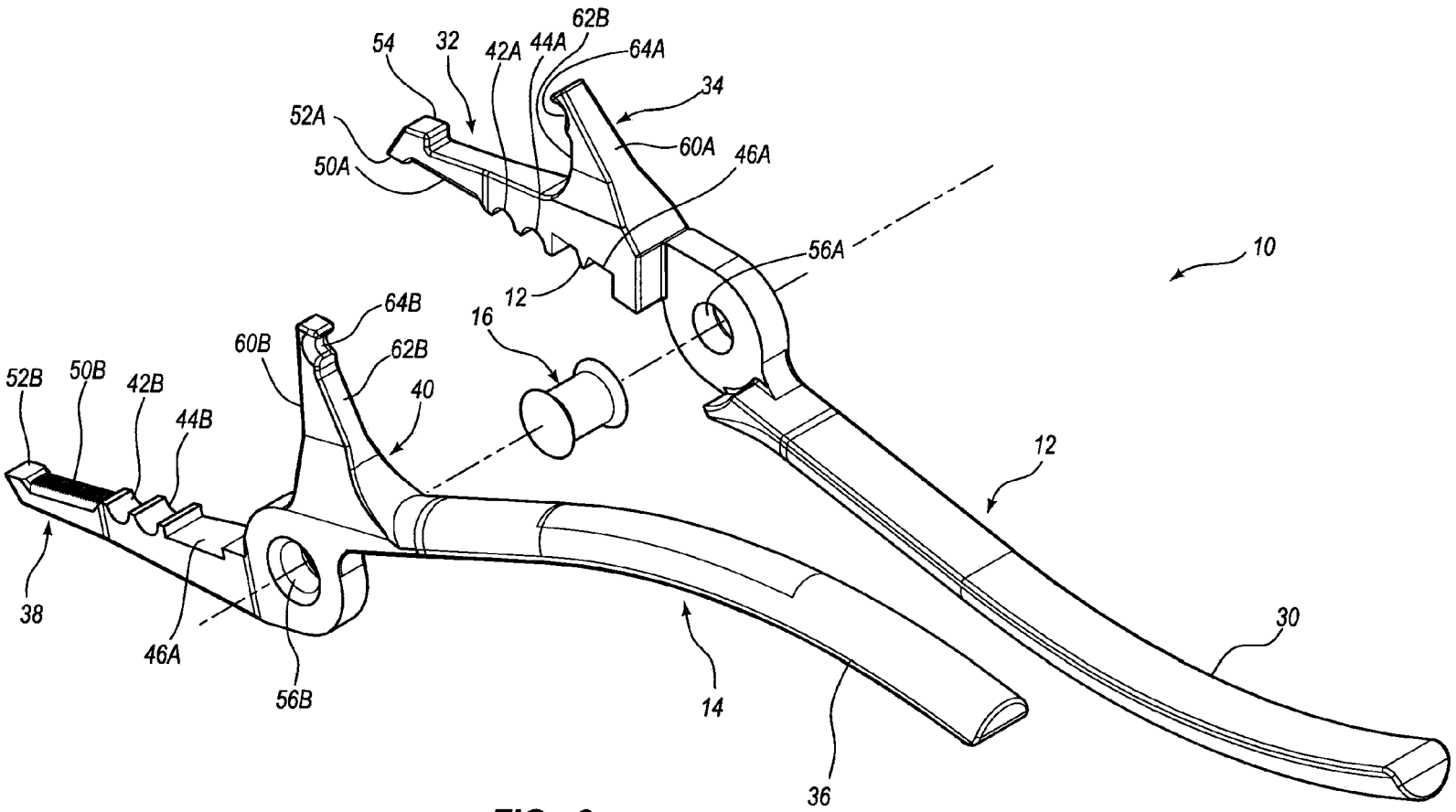
FIG. 8 is an exploded perspective view of the multi-function tool of FIG. 1.

Referring now to FIGS. 1-8, and particularly FIGS. 1, 2 and 8, an example multi-function tool 10 is shown including first and second plier members 12, 14, and a pivot connector 16. The first plier member 12 includes a first handle 30, a first jaw member 32, and a second jaw member 34. The second plier member 14 includes a second handle 36, a third jaw member 38, and a fourth jaw member 40. The first and second plier members 12, 14 are pivotally connected to each other with the pivot connector 16, which defines a pivot connection point. The first and second handles 30, 36 may be pivoted toward each other upon application of a squeezing force by one or more hands of an operator. Moving the first and second handle 30, 36 toward each other causes the first and third jaw members 32, 38 to pivot toward each other, and causes the second and fourth jaw members 34, 40 to pivot away from each other. Accordingly, applying a squeezing force to first and second handles 30, 36 may concurrently provide a clamping or gripping force applied by the first and third jaw members 32, 38 moving toward each other, and provide a spreading or stretching force applied by the second and fourth jaw members 34, 40 moving away from each other.

The first and third jaw members 32, 38 may be referred to as a first jaw set or a forward facing jaw of the multi-function tool 10. The first and third jaw members 32, 38 move laterally relative to a longitudinal axis L extending along a length of the multi-function tool 10 (see FIGS. 3-5). The first and third jaw members 32, 38 move toward and away from the longitudinal axis L upon moving the first and second handles 30, 36 toward and away from each other, respectively.

The second and fourth jaw members 34, 40 may be referred to as a second jaw set or a side facing jaw of the multi-function tool 10. The second and fourth jaw members 34, 40 move axially relative to the longitudinal axis L. Moving the first and second handles 30, 36 toward and away from each other moves the second and fourth jaw members 34, 40 away and toward each other, respectively.

Moving the first and second handles 30, 36 toward each other performs the many intended functions of the multi-function tool 10 described above. Moving the first and second handles 30, 36 away from each other makes features of the multi-function tool 10 accessible as part of preparing to perform one of the functions resulting from moving the first and second handles 30, 36 toward each other. For example, moving the first and second handles 30, 36 away from each other spaces apart the first and third jaw members 32, 38 so that an object may be positioned there between such that when the first and second handles 30, 36 are moved toward each other by application of a squeezing force, the object will be clamped between the first and third jaw members 32, 38.

The first jaw member 32 includes first and second nock recesses 42A, 44A, a nock removal recess 46A, a nock removal protrusion 48, a knurled separated portion 50A, a tweezer tip 52A, a cleat post 54, and a pivot aperture 56A (see FIG. 8). The third jaw member 38 includes first and second nock recesses 42B, 44B, a nock removal recess 46B, a knurled separated portion 50B, a tweezer tip 52B, and a pivot aperture 56B (see FIG. 8).

Figure 3:
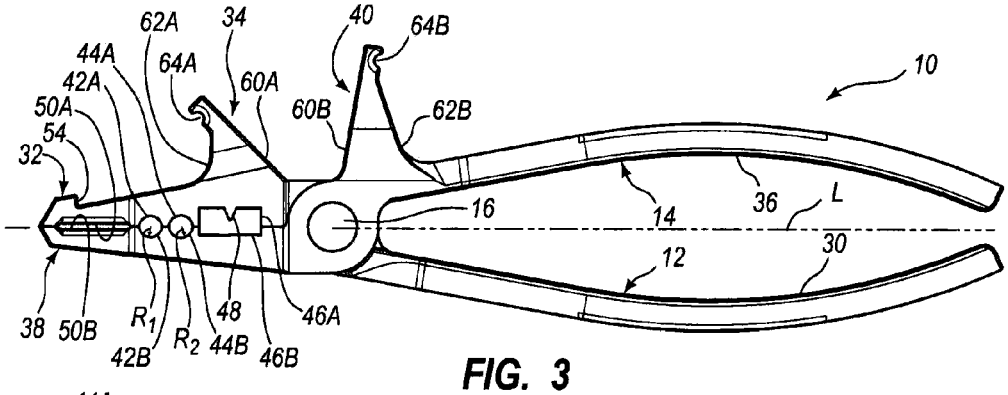
FIG. 3 is a side view of the multi-function tool of FIG. 1 in a closed position.

When the multi-function tool 10 is assembled, the first nock recesses 42A, 42B, the second nock recesses 44A, 44B, the nock removal recesses 46A, 46B, the knurled separated portions 50A, 50B, and the tweezer tips 52A, 52B are all aligned with and positioned directly adjacent to each other when the multi-function tool 10 is in a closed position, as shown in FIG. 3.

Figure 4:
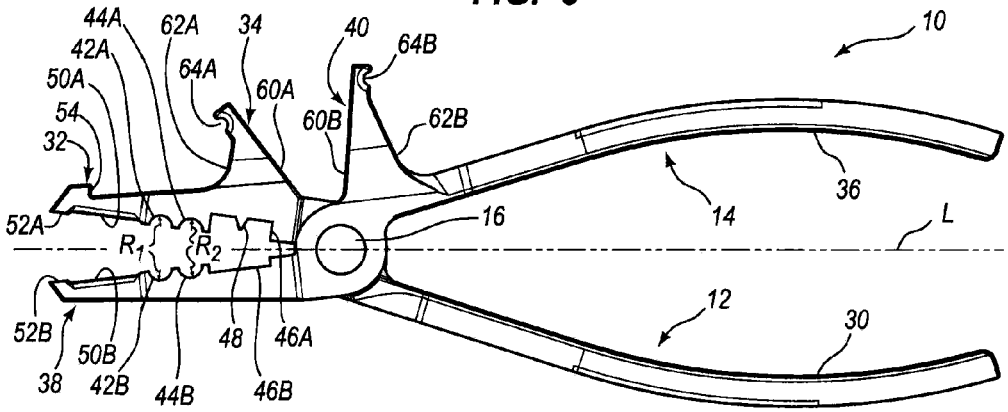
FIG. 4 is a side view of the multi-function tool of FIG. 1 in a partially opened position.
Figure 5:
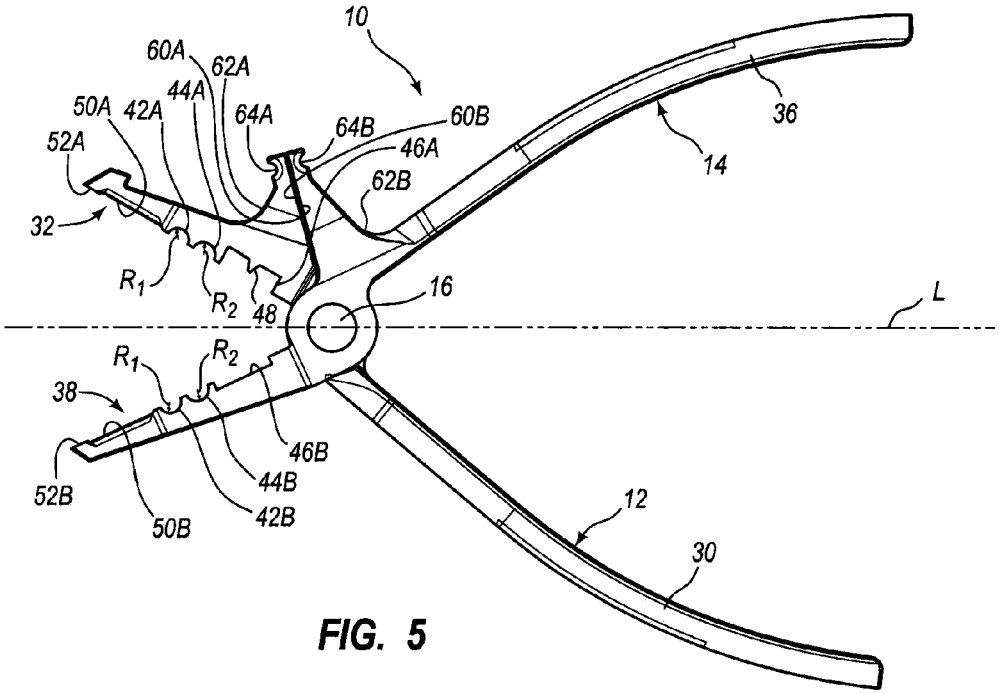
FIG. 5 is a side view of the multi-function tool of FIG. 1 in a fully opened position.

The first and second nock recesses 42A, 42B and 44A, 44B may have different sizes. FIGS. 3-5 show radiuses $R_1$ for first nock recesses 42A, 42B, and radiuses $R_2$ for second nock recesses 44A, 44B. The radiuses $R_1$, $R_2$ are known to persons of ordinary skill in the art, and are standard nock point sizes typically available in the industry.

The nock removal protrusion 48 may have a generally wedge-shaped construction. The nock removal protrusion 48 may have a triangular cross-sectional shape, as shown in at least FIGS. 3-5. Other shapes, sizes, constructions and orientations are possible for the nock removal protrusion 48 while still providing the same or similar function of removing a nock point from a bowstring. In some arrangements, one or both of the nock removal recesses 46A, 46B may have a contoured shape that matches an outer profile or size of a nock point to be removed from the bowstring. The shape or size of the nock removal recesses 46A, 46B may correspond to an outer shape and size of a nock point when the nock point is in an open position such that the nock point has the ability to expand within the recess upon being contacted with the nock removal protrusion 48.

The knurled separated portions 50A, 50B may be recessed relative to the surfaces of the tweeze tip 52A, 52B and other contact surfaces spaced between the knurled separated portions 50A, 50B, the first and second nock recesses 42A, 42B and 44A, 44B, and the nock removal recesses 46A, 46B. At least FIG. 3 shows a gap or space provided between the knurled separated portions 50A, 50B when the multi-function tool 10 is in a closed position. Each of the knurled separated portions 50A, 50B may include a surface feature such as knurling, grooves, protrusions or surface roughening that may provide increased gripping of an object held between the knurled separated portions 50A, 50B. In some embodiments, one or both of the knurled separated portions is not recessed and/or does not include a surface feature (e.g., has a smooth surface).

The knurled separated portions 50A, 50B may be particularly designed and well suited for gripping a string loop cord for the purpose of grasping and applying a tension force in the cord to tighten one or more knots of the string loop. The knurled separated portions 50A, 50B may be useful for grasping other structures to provide any number of standard gripping operations to apply, for example, a clamping force, a tension force, or a torque force to an object.

The tweezer tips 52A, 52B may have mating planar surfaces that terminate at a pointed tip structure. The tweezer tips 52A, 52B may be structured and oriented in a way that provides improved grasping of relatively small objects such as a piece of serving. Further, the pointed, tapered shape of the tweezer tips 52A, 52B may assist in inserting the tweezer tips 52A, 52B into a small opening such as into a space between strands of a bowstring and then grasping a stretch of serving and pulling the serving through the bowstring strands.

A single cleat post 54 is shown in the figures positioned on only the first jaw member 32. The multi-function archery tool 10 may have other arrangements for the cleat post 54 including, for example, a cleat post positioned on the third jaw member 38 or a plurality of cleat posts on either one of the first and third jaw members 32, 38. The purpose and function of the cleat post 54 is described in further detail below.

Referring again to FIGS. 1 and 2, the second jaw member 34 includes an inner surface 60A, an outer surface 62A, and a concave area or cord recess 64A (also referred to as a string loop receiving recess). The fourth jaw member 40 includes an inner surface 60B, an outer surface 62B, and a concave area or cord recess 64B (also referred to as a string loop receiving recess). The inner surfaces 60A, 60B are generally planar and may be arranged and configured to contact each other when the multi-function tool 10 is in a fully opened position (see FIG. 5). An interface between the inner surfaces 60A, 60B may provide a stop position for the multi-function archery tool 10 as the first and second handles 30, 36 are pivoted away from each other. The outer surfaces 62A, 62B may have a contoured shape. The cord recesses 64A, 64B may be sized to receive a portion of a cord, wire, string or other object such as a portion of a bowstring or a portion of a string loop cord.

The second jaw member 34 is carried by or otherwise mounted to the first jaw member 32. The second jaw member 34 is positioned distal of the pivot connector 16. The fourth jaw member 40 is carried by the second handle 36. The fourth jaw member 40 is positioned proximal of the pivot connector 16. Generally, the first and third jaw members 32, 38 are positioned distal of the pivot connector 16, and the first and second handles 30, 36 are positioned proximal of the pivot connector 16.

The second and fourth jaw members 34, 40 are oriented extending in a common direction such as in a side or lateral direction relative to a longitudinal axis L of the multi-function tool 10. The second and fourth jaw members 34, 40 move axially relative to the longitudinal axis L. The second and fourth jaw members 34, 40 rotate or pivot about the pivot connector 16 and its associated pivot axis extending laterally through the multi-function tool 10. Typically, the second and fourth jaw members 34, 40 are positioned on opposite sides of the pivot connector 16. The first and third jaw members 32, 38 also pivot about the pivot connector 16 and are both positioned distal of the pivot connector 16 and associated pivot axis.

FIG. 3 shows the multi-function archery tool 10 in a closed position with the first and third jaw members 32, 38 in contact with each other and the second and fourth jaw members 34, 40 separated a maximum distance from each other. FIG. 4 shows the multi-function tool 10 partially opened with the first and third jaw members 32, 38 spaced apart from each other and the second and fourth jaw members 34, 40 spaced apart from each other. FIG. 5 shows the multi-function tool 10 in a fully opened position with the first and third jaw members 32, 38 separated a maximum distance and the second and fourth jaw members 34, 40 in contact with each other or spaced at a minimum distance from each other. FIGS. 6 and 7 show top and bottom views of the multi-function tool 10 when the multi-function tool 10 is arranged in the upright position shown in FIG. 1. FIG. 8 is an exploded perspective view of the multi-function tool 10.

Figure 9A:
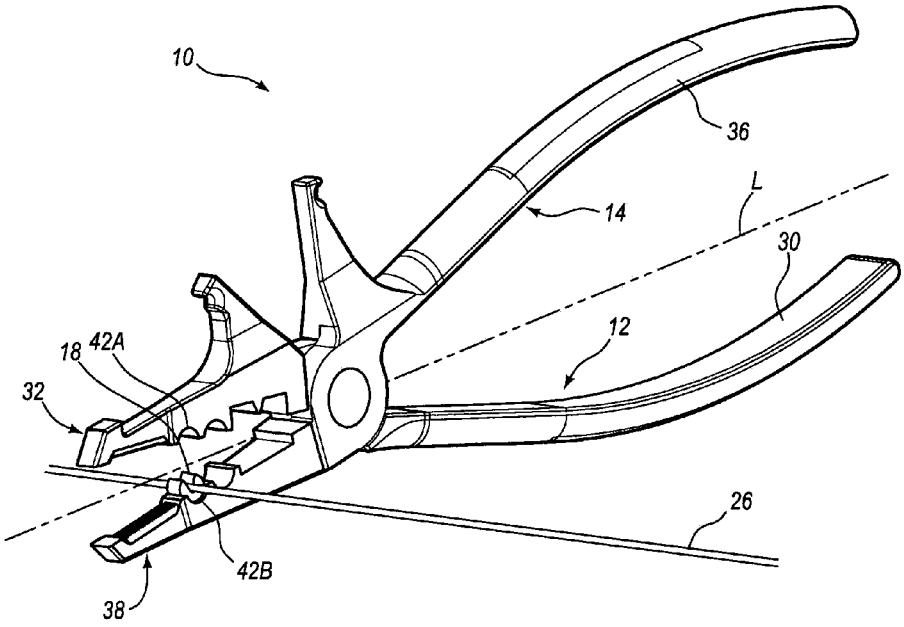
FIGS. 9A-9C show the multi-function tool of FIG. 1 in operation mounting a nock point to a bowstring.
Figure 9B:
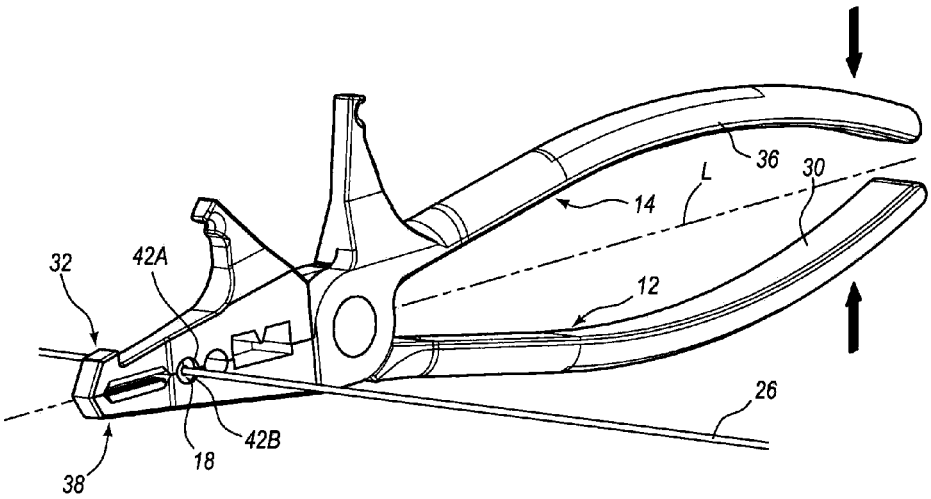
Figure 9C:
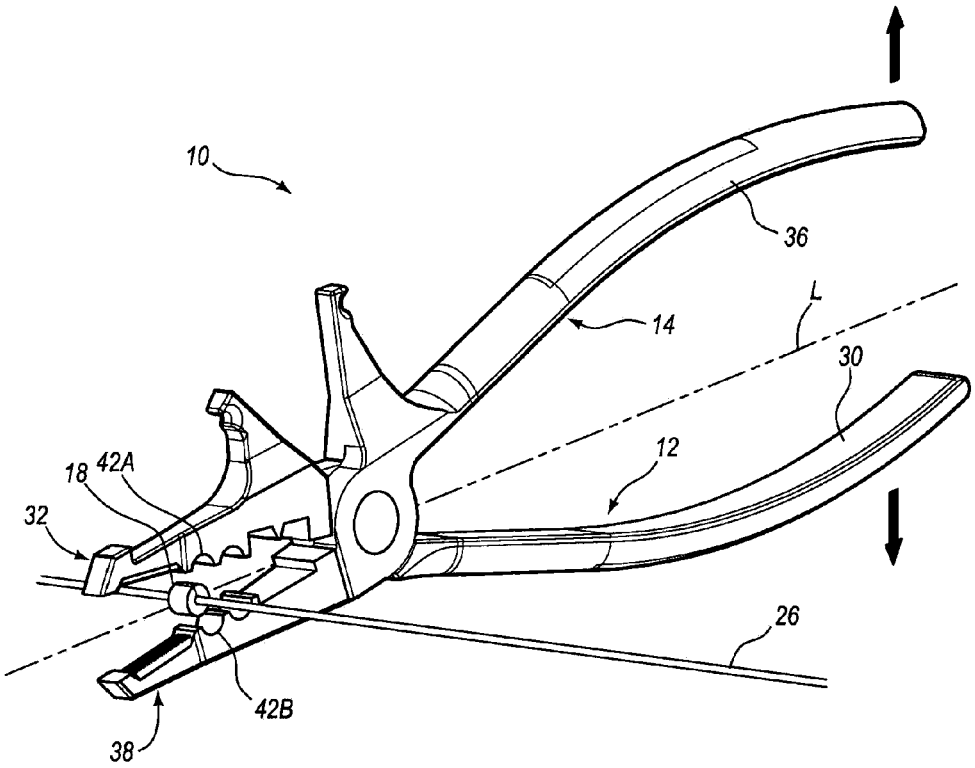

FIGS. 9A-9C show operation of the multi-function archery tool 10 to mount a nock point 18 onto a bowstring 26. FIG. 9A shows the multi-function tool 10 in a partially opened position with the first and third jaw members 32, 38 separated an amount sufficient to permit positioning of the nock 18, which has already been positioned on the bowstring at a desired location, between the first nock recesses 42A, 42B. In alternative arrangements (e.g., when using a different sized nock point), the nock point 18 may be positioned between the second nock recesses 44A, 44B. The bowstring 26 extends perpendicular to the first and third jaw members 32, 38 and longitudinal axis L.

FIG. 9A shows the multi-function tool 10 having a squeezing force applied to the first and second handles 30, 36, which translates to a clamping force being applied to the nock point 18. The clamping force compresses or crimps the nock point 18 onto the bowstring 26. After sufficiently crimping the nock point 18 onto bowstring 26, the operator may move the first and second handles 30, 36 away from each other so that the multi-function tool 10 may be removed from the nock point 18 and bowstring 26, as shown in FIG. 9C. After attaching the nock point 18 to bowstring 26 as shown in FIGS. 9A-9C, the multi-function tool 10 may be used to apply additional clamping or crimping forces to the nock point 18 by positioning the nock point 18 between the knurled separated portions 50A, 50B or between the tweezer tips 52A, 52B, and thereafter applying a squeezing force to first and second handles 30, 36.

Figure 10A:
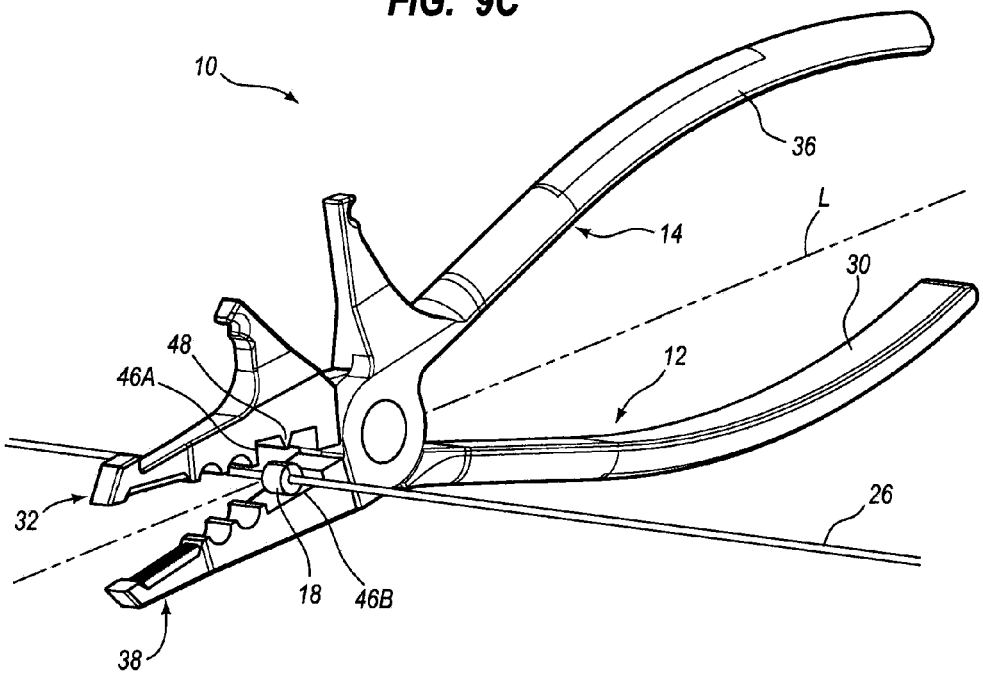
FIGS. 10A-10C show the multi-function tool of FIG. 1 in operation removing a nock point from a bowstring.
Figure 10B:
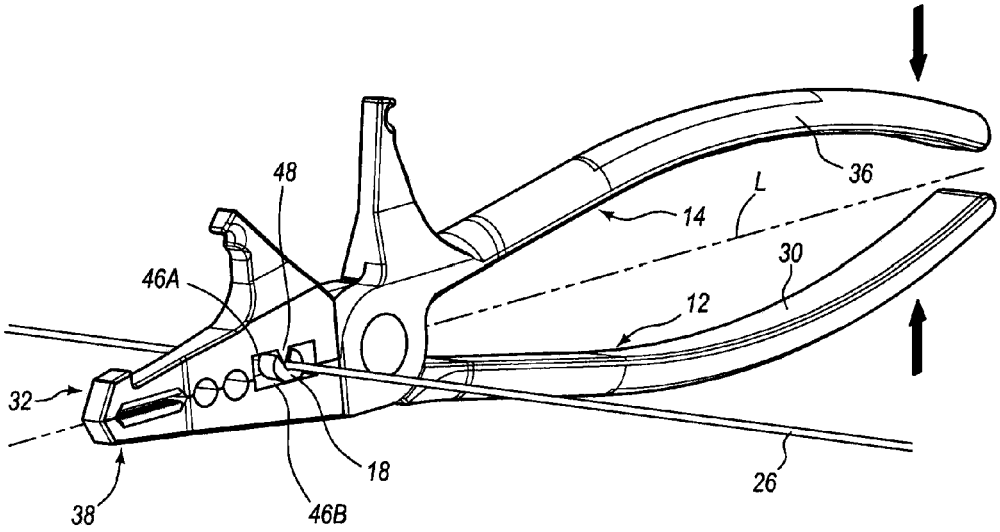
Figure 10C:
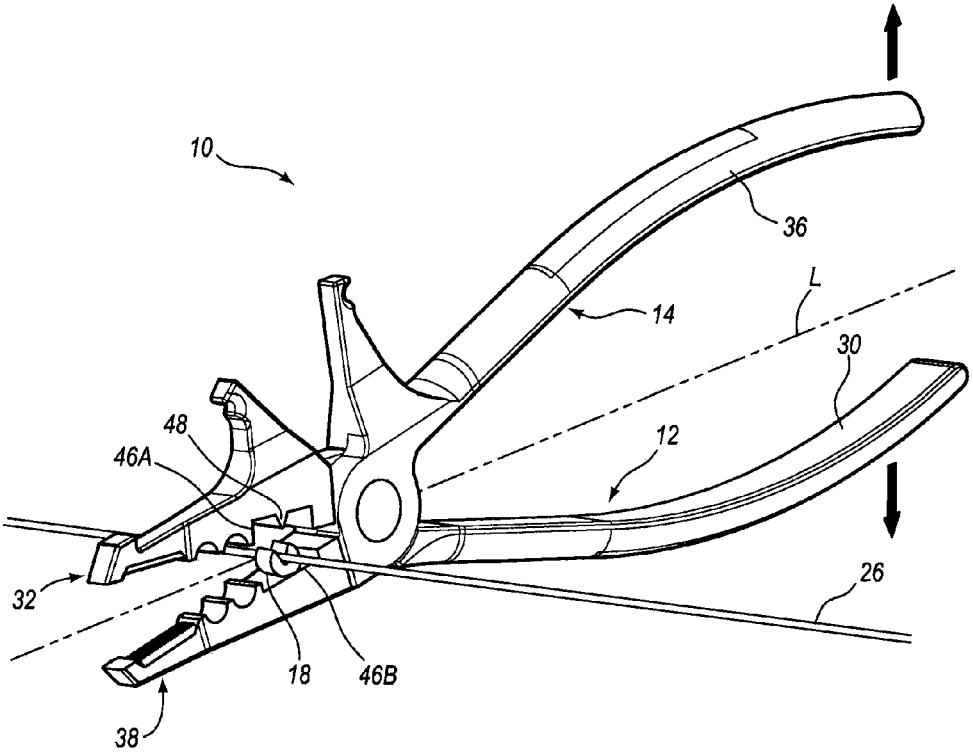

FIGS. 10A-10C show operation of the multi-function tool 10 to remove the nock point 18 from the bowstring 26. FIG. 1OA shows the multi-function tool 10 open a sufficient amount to position the nock point 18 within the nock removal recesses 46A, 46B and in alignment with the nock removal protrusion 48. FIG. 10B shows a squeezing force applied to first and second handles 30, 36, which results in the nock removal protrusion 48 being forced into the area between the ends of the nock point 18. Further squeezing the first and second handles 30, 36 forces the protrusion further into the ends of the nock point 18 to pry apart the ends of nock point 18 an amount sufficient to allow it to be removed from or adjusted relative to the bowstring. The wedge-shaped design of a nock removal protrusion 48 may assist in forcing into and spreading apart the ends of nock point 18. FIG. 10C shows the multi-function archery tool 10 moved into an open position by moving the first and second handles 30, 36 away from each other, thereby permitting the multi-function tool 10 to be removed from the nock point 18 and bowstring 26.

In other embodiments, one or both of the nock removal recesses 46A, 46B may be eliminated from the multi-function tool 10. The nock removal protrusion 48 may be positioned at any location along the length of either one of the first and third jaw members 32, 38. Various features may be formed in the first and third jaw members 32, 38 to hold the nock point 18 in a fixed position while engaging the nock removal protrusion 48 against the nock point 18 to pry open the nock point 18. In at least some examples, the nock removal protrusion 48 may be positioned proximal of the pivot connector 16 rather than distal of the pivot connector 16.

Figure 11:
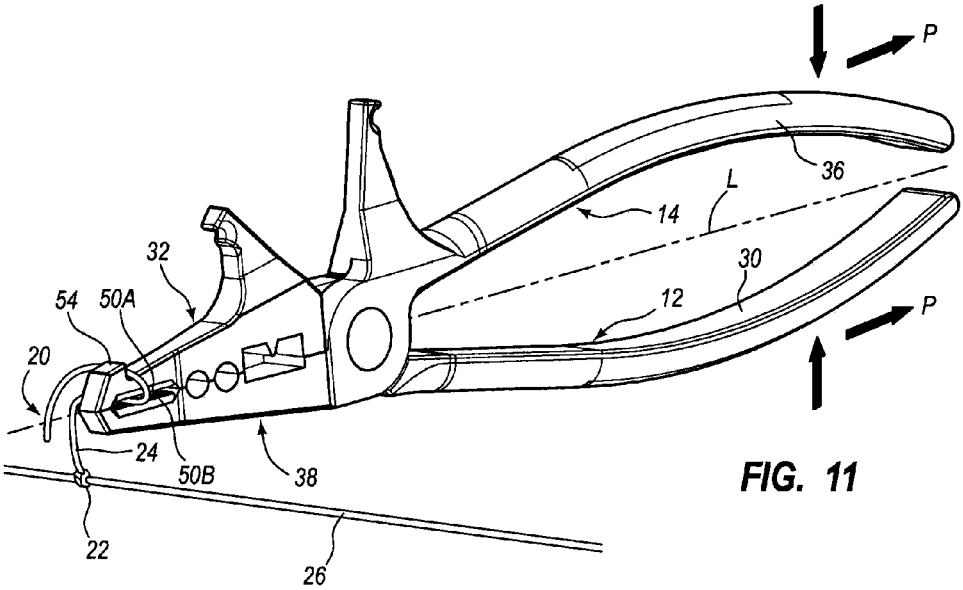
FIG. 11 shows the multi-function tool of FIG. 1 in operation tightening a string loop knot.

FIG. 11 shows operation of the multi-function archery tool 10 to tighten the knots of a string loop 20, which is attached to bowstring 26. A first knot 22 (e.g., a half-hitch knot) is formed in a first free end of a cord used to form string loop 20. The opposite free end of the string loop cord is positioned between the knurled separated portions 50A, 50B in the partially opened multi-function archery tool 10. The free end of the string loop cord is then wrapped over an opposite side of the first jaw member 32 from the knurled separated portion 50A and held in place at least in part by the cleat post 54. The operator then squeezes the first and second handles 30, 36 toward each other to grip the string loop cord between the knurled separated portions 50A, 50B. The operator then applies a tension force in a proximal direction P with the hand being used to grip the handles 30, 36 of multi-function tool 10 while holding the bowstring 26 in an opposite hand. The applied tension in the string loop cord provides tightening of knot 22. In at least some examples, the free end of the string loop cord may be wrapped around the first and third jaw members 32, 38 adjacent to the cleat post 54 prior to applying the tension force in the direction P.

Figure 13A:
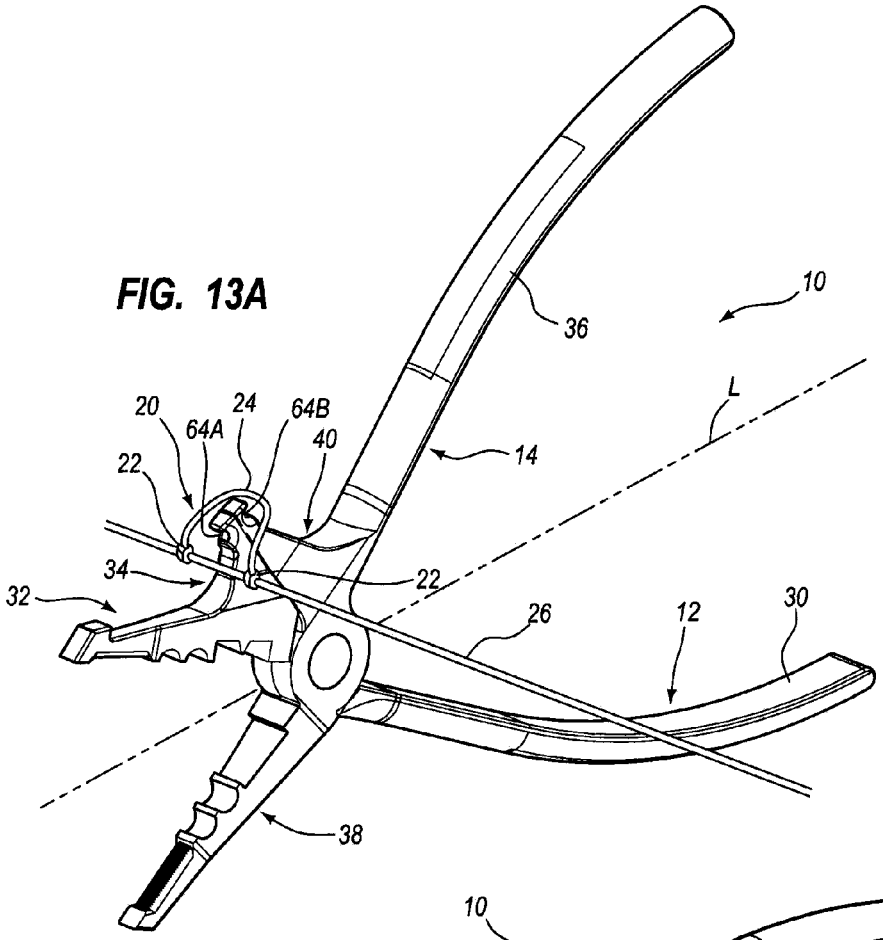
FIGS. 13A and 13B show the multi-function tool of FIG. 1 in operation tightening a string loop on a bowstring.
Figure 13B:
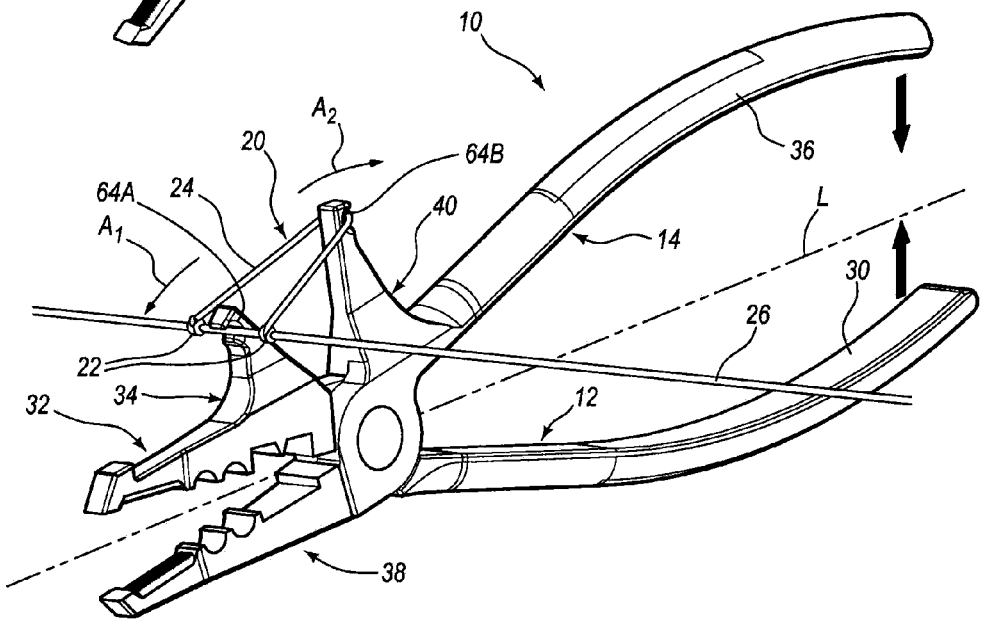

Applying tension to the string loop 20 using the knurled separated portion 50A, 50B may be performed after both free ends of the string loop cord are tied in knots 22 about the bowstring 26. FIGS. 13A and 13B show the string loop 20 in such an arrangement. Rather than using the second and fourth jaw members 34, 40 to tighten both knots 22 (e.g., as described below with reference to FIGS. 13A and 13B), the user may grasp loop 24 of string loop 20 between the knurled separated portions 50A, 50B and apply the tension force in direction P to tighten knots 22.

Figure 12:
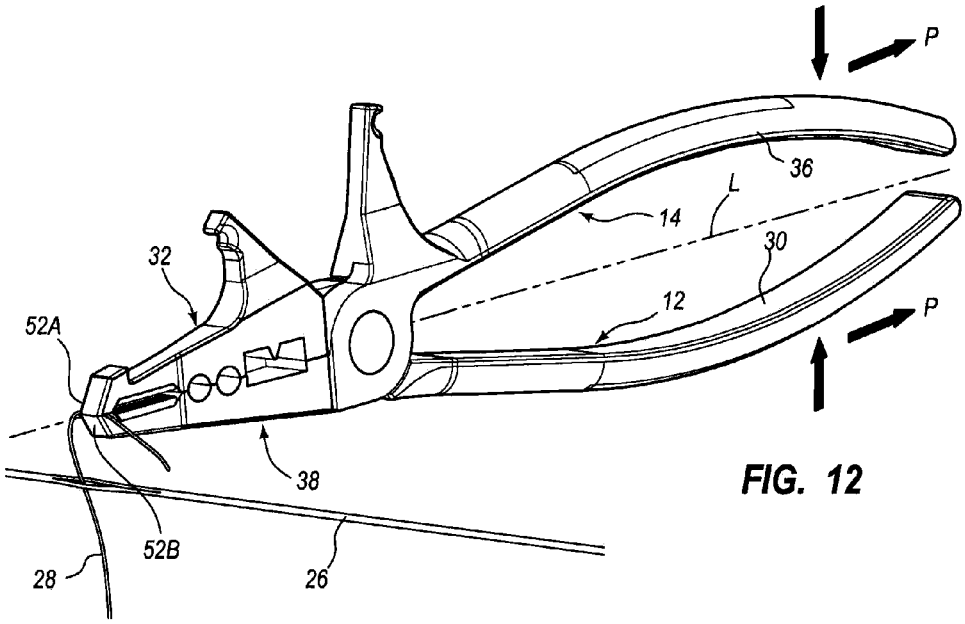
FIG. 12 shows the multi-function tool of FIG. 1 in operation pulling a piece of serving through a bowstring.

Referring now to FIG. 12, the multi-function tool 10 is shown in operation pulling a piece of serving 28 between strands of bowstring 26. The operator may force the tweezer tips 52A, 52B between the strands of bowstring 26 and grasp serving 28 between the tweezer tips 52A, 52B, and then pull the multi-function tool 10 and serving 28 back out of the strands of bowstring 26. In another example, serving 28 is fed between the bowstring strands with the user's fingers and then grasped with the tweezer tips 52A, 52B by applying a squeezing force to the first and second handles 30, 36. The operator may then apply a tension force in the direction P to pull the serving 28 through the bowstring strands.

The tweezer tips 52A, 52B may provide the option of grasping relatively small objects with the multi-function tool 10. The shape and size of tweezer tips 52A, 52B may also assist in directing the multi-function tool 10 through relatively small openings. The tapered leading edge of the multi-function tool 10 defined by the tweezer tips 52A, 52B may provide the operator with relatively precise and accurate grasping of small objects.

FIGS. 13A and 13B show the multi-function tool 10 in operation tightening a newly formed string loop 20 on bowstring 26. The first and second handles 30, 36 are pivoted away from each other until the second and fourth jaw members 34, 40 are positioned close enough together that the second and fourth jaw members 34, 40 may be positioned between loop 24 of string loop 20 and bowstring 26, as shown in FIG. 13A. The cord recesses 64A, 64B may be aligned with and/or positioned in contact with one or both of the loop 24 and bowstring 26. Thereafter, as shown in FIG. 13B, the operator may apply a squeezing force to first and second handles 30, 36, which pivots the second and fourth jaw members 34, 40 away from each other in axial directions $A_1$, $A_2$, respectively. The operator has maximum mechanical advantage in applying the tension force between bowstring 26 and loop 24 by being able to squeeze first and second handles 30, 36 relative to each other. The operation of multi-function tool 10 has the advantage of being able to apply a tension force to string loop 20 to tighten knots 22 using a single handed squeeze of first and second handles 30, 36. The operation of the side facing jaw by squeezing together first and second handles 30, 36 provides added mechanical advantage and ease of operation as compared to other types of tools in which the handles must be pried away from each other with two hands and using less mechanical advantage in order to apply the tension force to the string loop.

A variety of methods of operation are possible as described above with reference to FIGS. 1-13B. One method of operation includes providing first and second handle members, a first set of jaws having first and second jaw members, and a second set of jaws having third and fourth jaw members. The method includes pivoting the first and second handle members toward each other to concurrently (1) open the second set of jaws to tighten a string loop, and (2) close the first set of jaws to either crimp a nock point onto a bowstring or remove the nock point from the bowstring. The first and second handles may be pivoted away from each other to open the first set of jaws to disengage the first set of jaws from the nock point and concurrently close the second set of jaws to remove the second set of jaws from the string loop.

The method may also include positioning portions of the string loop within recesses formed on at least one of the third and fourth jaw members. The recesses may be formed on outer surfaces of the third and fourth jaw members that face away from the opposing jaw member. The method may also include positioning portions of the nock point within nock recesses formed in at least one of the first and second jaw members. The nock recesses may have various sizes and shapes to accommodate different sized and shaped nock points. The first and second jaw members may move in a lateral direction relative to the longitudinal axis of the multi-function archery tool, and the third and fourth jaw members may move in an axial direction relative to the longitudinal axis. The first and second jaw members and third and fourth jaw members may be pivotally connected to each other.

Another example method in accordance with the present disclosure relates to operating a multi-function archery tool. The method includes providing first and second handle members, a first set of jaws having first and second jaw members, and a second set of jaws having third and fourth jaw members. Moving the first and second handle members toward each other concurrently closes the first set of jaws and opens the second set of jaws. The first set of jaws may be facing in a forward direction and may move laterally relative to a longitudinal axis of the multi-function tool. The second set of jaws may face in a side direction and may move axially relative to the longitudinal axis of the multi-function tool. The first set of jaws may be configured to perform a variety of functions including, for example, crimping a nock point onto a bowstring, removing the nock point from the bowstring, grasping a piece of serving and/or pulling a piece of serving or other object through strands of the bowstring, and grasping a portion of a string loop to apply a clamping or tension force. The second set of jaws may be configured to apply a tension force for use in, for example, tightening knots of a string loop (e.g., a pair of half-hitch knots of a string loop) which is mounted to the bowstring.

It is desired that the embodiments described herein be considered in all respects illustrative and not restrictive and that reference be made to the appended claims and their equivalents for determining the scope of the instant disclosure. For ease of use, the words "including" and "having," as used in the specification and claims, are interchangeable with and have the same meaning as the word "comprising."

What is claimed is:

1. A multi-function archery tool, comprising:

first and second handle members pivotally connected to each other at a connection point;

a first set of jaws having first and second jaw members movable toward each other to clamp a nock point upon moving the first and second handle members toward each other;

a second set of jaws having third and fourth jaw members movable away from each other to tighten a bowstring string loop upon moving the first and second handle members toward each other;

a knurled separated jaw section formed in the first and second jaw members;

at least one nock removal recess having a flat surface formed in one of the first and second jaw members and sized to receive a nock;

a nock removal protrusion formed in the other one of the first and second jaw members corresponding to the nock removal recess;

wherein the knurled separated jaw section, the at least one nock recess, and the nock removal protrusion are arranged in series and positioned distal of the connection point.

2. The multi-function archery tool of claim 1, wherein the first and third jaw members are integrally formed as a single piece with the first handle member, and the second and fourth jaw members are integrally formed as a single piece with the second handle member.

3. The multi-function archery tool of claim 1, wherein the first and second jaw members are in contact with each other when the multi-function archery tool is in a closed position with the first and second handle members arranged adjacent to each other, and the third and fourth jaw members are in contact with each other when the multi-function archery tool is in an open position with the first and second handle members arranged spaced apart from each other.

4. The multi-function archery tool of claim 1, wherein the first and second jaw members each include plurality of nock recesses sized to receive the nock.

5. The multi-function archery tool of claim 1, wherein at least one of the first and second jaw members includes a nock removal protrusion.

6. The multi-function archery tool of claim 1, wherein the third and fourth jaw members each include an inner surface, an outer surface, and a string loop receiving recess formed on the outer facing surface.

7. The multi-function archery tool of claim 1, wherein at least one of the first and second jaw members includes a knurled separated jaw portion configured to grasp a portion of the string loop.

8. The multi-function archery tool of claim 1, wherein the first and second jaw members define a tweezer tip.

9. The multi-function archery tool of claim 1, wherein the first and second handle members are pivotally connected to each other at a pivot connection point, the third jaw member being positioned distal of the pivot connection point and the fourth jaw member being position proximal of the pivot connection point.

10. A multi-function archery plier, comprising; a first plier member comprising:

a first handle portion positioned at a first end thereof;

a first jaw portion positioned at a second end thereof;

a second jaw portion spaced between the first and second ends;

a second plier member pivotally attached to the first plier member at a connection point and comprising;

a second handle portion positioned at a first end of the second plier member;

a third jaw portion positioned at a second end of the second plier member; a fourth jaw portion spaced between the first and second ends of the second plier member;

a knurled separated jaw section formed in at least one of the first and second jaw members and configured to grasp a portion of a string loon;

at least one nock removal recess having a flat surface formed in at least one of the first and second jaw members and sized to receive a nock;

a nock removal protrusion formed in at least one of the first and second jaw members and operable to open a nock corresponding to the nock removal recess;

at least one string loop recess formed in at least one of the third and fourth jaw members and sized to receive a portion of a string loop, the at least one string loop recess including rounded edges;

wherein the knurled separated jaw section, the at least one nock recess, and the nock removal protrusion are arranged in series and positioned distal of the connection point;

wherein the first and third jaw portions are movable laterally relative to a longitudinal axis of the multi-function archery plier, and the second and fourth jaw portions are movable axially relative to the longitudinal axis;

wherein moving the first and second handle portions toward each other concurrently moves the first and third jaw members toward each other and moves the second and fourth jaw members away from each other.

11. The multi-function archery plier of claim 10, wherein the first, second and third jaw members are positioned distal of the connection point between the first and second plier members, and the fourth jaw member is positioned proximal of the pivot connection point.

12. The multi-function archery plier of claim 10, wherein each of the first and third jaw members includes a plurality of nock recesses.

13. The multi-function archery plier of claim 10, wherein at least one of the first and third jaw members includes a recessed portion positioned adjacent to and surrounding the at least one nock removal protrusion.

14. The multi-function archery plier of claim 10, wherein the multi-function archery plier is operable between a fully open position wherein the second and fourth jaw members are in contact with each other, and a fully closed position wherein the first and third jaw members are in contact with each other.

15. The multi-function archery plier of claim 10, further comprising a cleat post extending from the first jaw portion and configured for securing a portion of the string loop when attaching the string loop to a bowstring.

16. The multi-function archery plier of claim 10, wherein the knurled separated jaw section is configured for to grasp a portion of the string loop when attaching the string loop to a bowstring.

17. A method of operating a multi-function archery tool, comprising:

providing first and second handle members pivotally connected to each other at a connection point, a first set of jaws having first and second jaw members, and a second set of jaws having third and fourth jaw members, the first set of jaws including a knurled separated jaw section, at least one nock recess, and a nock removal protrusion, the second set of jaws including at least one string loon recess, the knurled separated jaw section, the at least one nock removal recess having a flat surface, and the nock removal protrusion are arranged in series and positioned distal of the connection point corresponding to the nock removal recess;

pivoting the first and second handle members toward each other to concurrently open the second set of jaws to tighten a string loop positioned in the at least one string loop recess and close the first set of jaws to either crimp a nock point that is positioned in the at least one nock recess onto a bowstring or remove the nock point from the bowstring using the nock removal protrusion;

pivoting the first and second handle members away from each other to open the first set of jaws to concurrently disengage the first set of jaws from the nock point and close the second set of jaws to remove the second set of jaws from the string loop.

18. The method of claim 17, further comprising positioning portions of the string loop within the at least one string loop recess formed in surfaces of the third and fourth jaw members that face in opposite directions.

19. The method of claim 17, further comprising positioning portions of the nock point within the at least one nock recesses recess, the at least one nock recess being formed in each of the first and second jaw members.

20. The method of claim 17, wherein the first and second jaw members move in a lateral direction relative to a longitudinal axis of the multi-function archery tool, and the third and fourth jaw members move in an axial direction relative to the longitudinal axis.

21. A method of operating a multi-function archery tool, comprising:

providing first and second handle members pivotally connected to each other at a connection point, a first set of jaws having first and second jaw members, and a second set of jaws having third and fourth jaw members, the first set of jaws including a tweezer tip, a knurled separated jaw section, at least one nock removal recess having a flat surface, and a nock removal protrusion corresponding to the nock removal recess, the second set of jaws including at least one string loop recess, the knurled separated jaw section, the at least one nock recess, and the nock removal protrusion being arranged in series and positioned distal of the connection point;

moving the first and second handle members toward each other to concurrently close the first set of jaws and open the second set of jaws;

mounting an open nock point on a bowstring and positioning the open nock point in the at least one nock recess, positioning a closed nock point that is mounted to the bowstring between the first and second jaw members and in alignment with the at least on nock removal protrusion, positioning a niece of string within the tweezer tip between the first and second jaw members, and positioning a portion of a string loop around the third and fourth jaw members and within the at least one string loop recess;

wherein the first set of jaws are configured to crimp the nock point onto the bowstring, remove the nock point from the bowstring, grasp the piece of string, and grasp a portion of a string loop, and the second set of jaws are configured to tighten the string loop onto the bowstring.

* * * * *